US005718490A

United States Patent [19]

Liao

[11] Patent Number: 5,718,490

[45] Date of Patent: Feb. 17, 1998

[54] ASSEMBLED CLOTHES STORAGE CLOSET

[76] Inventor: Jerry Liao, SL5, No. 27, Alley 19 Lane 160, Ming Chung East Road, Taipei, Taiwan

[21] Appl. No.: 46,945

[22] Filed: Apr. 16, 1993

[51] Int. Cl.[6] ..... E04H 1/12

[52] U.S. Cl. ..... 312/6; 135/157

[58] Field of Search ..... 312/3, 4, 5, 6; 135/157

[56] References Cited

FOREIGN PATENT DOCUMENTS

| | | | |
|---|---|---|---|
| 0183192 | 2/1955 | Austria | 312/3 |
| 1381948 | 2/1964 | France | 312/3 |
| 1445789 | 6/1965 | France | 312/3 |
| 1467955 | 12/1966 | France | 312/3 |

*Primary Examiner*—Peter M. Cuomo
*Assistant Examiner*—Gerard A. Anderson
*Attorney, Agent, or Firm*—Myron Amer PC

[57] ABSTRACT

A portable clothes storage closet having a compact travel condition in which the closet components are disassembled and, at the point of use, are assembled within the outer fabric cover into an optimum size providing adequate storage space, the assembly within the outer fabric cover permitting a size in the closet outer fabric-support structure that could not readily fit through the opening into the closet. Also, the size of the compartment bounded by the fabric cover is selected to approximate that of the support structure so that the closing of the opening into the closet which is provided in the fabric cover creates a tautness in the fabric cover about the support structure which obviates inadvertent disassembly of the components of the support structure while the closet is in use.

1 Claim, 1 Drawing Sheet

ASSEMBLED CLOTHES STORAGE CLOSET

The present invention relates generally to a portable closet primarily for the storage of clothes on hangers, and more particularly to a closet that has a compact non-use condition which renders it portable, and also an optimum large-sized configuration which in use bounds a corresponding storage compartment of note-worthy size.

EXAMPLE OF THE PRIOR ART

There are already numerous well known collapsing structures variously denominated as a garment bag, a portable wardrobe or, simply, a clothing rack with a cover. In each the objective is to achieve portability by using to advantage the collapsibility of the structure in going optionally to and from a compact condition and a larger erected condition.

Exemplifying the noted prior art collapsing closet structures is the luggage unit described and illustrated in U.S. Pat. No. 2,806,563 issued to H. E. Einhorn on Sep. 17, 1957 which has an unfolding wire frame that from a FIG. 2 collapsed condition assumes a FIG. 3 three dimensional rectangular configuration serving as a clothes storage closet. While portability is achieved by the compactness and nominal space requirements of the wire frame, the open or unfolded configuration of the wire frame which, of course, defines the amount of storage space that is made available to the user, is usually not as large as desired by the user. Of necessity, it is a function of the articulating wire frame, which is selected to provide a compact collapsed condition and yet is required to open or unfold into an optimumly large three dimensional configuration. These objectives conflict, and a satisfactory compromise has not heretofore been achieved.

Broadly, it is an object of the present invention to provide a portable clothes closet overcoming the foregoing and other shortcomings of the prior art. More particularly, it is an object to provide a clothes storage closet that is convenient, in its non-use condition, for transport and, at its intended place of use, is readily made to assume a noteworthy increased size providing adequate storage space that has no limitation significantly imposed on its size by any support structure of an interconnected nature in its non-use condition. Rather, as will become more apparent as the description proceeds, the support structure is unconnected when not is use, and is readily connected at its point of use. Moreover, since it is of a noteworthy size preparatory to serving as internal support for the closet protective external cover, it cannot conveniently be inserted within the external cover. Thus, in accordance with the present invention, the support structure is erected within the external closet cover by the user inserting his/her hands through an access opening in the cover and interconnecting the components to each other in an orderly fashion, e.g. erecting a bottom, a side one at a time, and so forth.

The description of a clothes storage closet having the unique attribute, according to the present invention, of being readily assembled and held in its assembled condition at a place of use, which follows, together with the accompanying drawings should not be construed as limiting the invention to the example shown and described, because those skilled in the art to which this invention appertains will be able to devise other forms thereof within the ambit of the appended claims.

Figure 2:
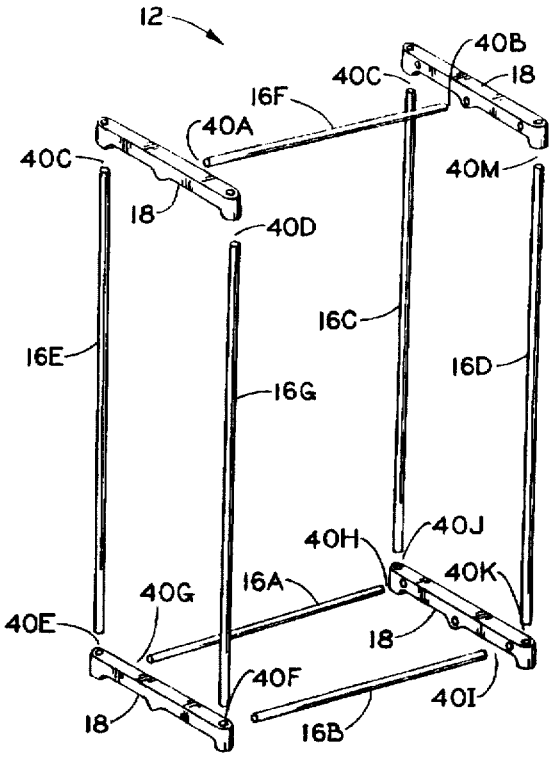
FIG. 2 is an exploded view of the internal support structure for the closet.
Figure 3:
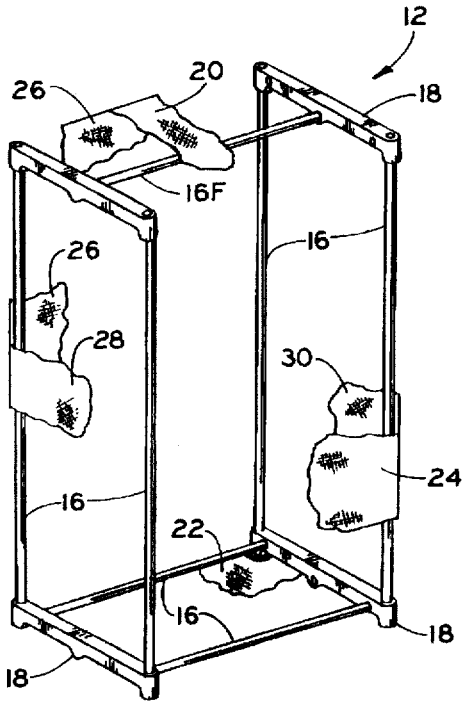
FIG. 3 is a view similar to FIG. 2 but showing the support structure in assembled condition and also in conjunction with its cooperating external fabric construction material components.
Figure 4:
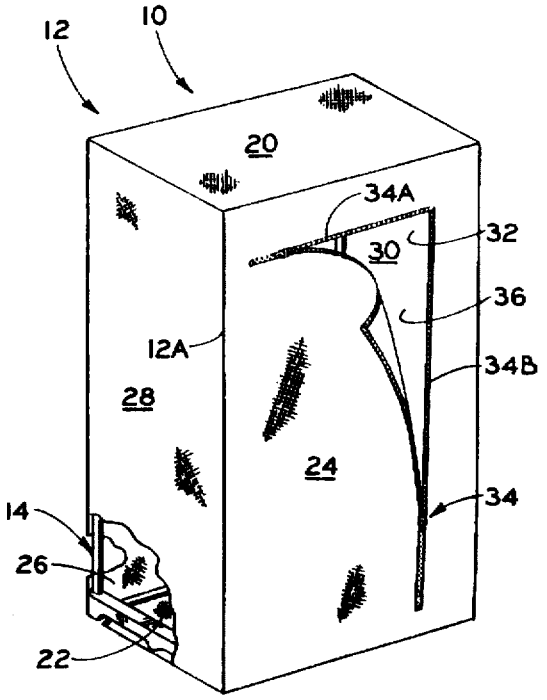
FIG. 4 is a perspective view of the within clothes storage closet in condition for use.

In FIG. 4, to which reference should first be made, there is shown a completely assembled clothes storage closet generally designated 10, consisting of an outer or external closure component, of preferably fabric construction material, generally designated 12, held in the erect condition illustrated by internal support structure, generally designated 14, shown also very clearly in FIGS. 2 and 3.

More particularly, as shown in FIGS. 2 and 3, support structure 12 is comprised of interconnected rods individually and collectively designated 16 and brackets, individually and collectively designated 18. As a preferred technique of interconnecting the brackets and rods, the brackets 18 are provided with female cylindrical openings sized to receive in a friction fit a cooperating cylindrical shaped end of a cooperating rod 16, both rods and brackets being preferably of wood construction material.

Underlying the inventive concept is the recognition that it would be advantageous if closet 10 was readily portable, such portability requiring that it have a very compact storage condition convenient for travel preparatory to ultimate use by the user and, at the point of use, have the increased size in which it effectively functions as a storage compartment or closet at the point of use, and as illustrated in FIG. 4. Essential to this concept of portability is the further requirement that the rods and brackets be capable of being assembled to each other very readily, by which is meant that the ease of connection also correspondingly have an ease of disconnection, and yet the connected rods and brackets must not be subject to inadvertent disconnection since such a tendency would interfere with the use of the closet 10 for the just-explained purposes intended.

Figure 1:
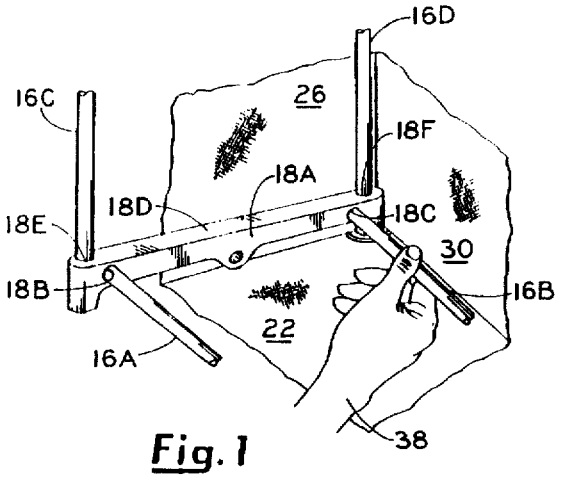
FIG. 1 is a partial perspective view showing the implementation of the inventive concept of assembling the clothes storage closet at the point of use.

Describing first the external closet-closure component, namely the previously referred to cover 12, as best shown in FIGS. 1 and 4, cover 12 is specifically comprised of cooperating panels forming a top 20, a bottom 22, a front 24, a back 26, a left side 28, and a right side 30, all of which in the erected or assembled condition of the closet 10 cooperate to bound a storage compartment 32 for the protected and convenient storage of clothes. In the front panel 24 there is provided zipper means 34 consisting of a horizontal length portion 34A and a vertically oriented length portion 34B. Length portions 34A,B are of a selected size to provide an appropriate large-sized access opening 36 into the storage compartment 32. In practice it has been found that in opening 32 to its fullest extent, as occurs when the vertical length 34B is completely unzippered, that it is one third the size of the front panel 24 and is effective to achieve a portable closet function in accordance with the present invention. Although other dimensions may also be useful, it will be understood that the closet illustrated in FIG. 4 has a height of 65", a side panel width of 19½", a front panel width of 36", a zipper horizontal component of 29", and a 56" zipper vertical component.

For completeness sake it is noted that the female openings of the brackets 18 are in some instances 1" diameter, and in other instances ⅝ diameter, and the rods 16 of corresponding diameters to provide a friction fit when the ends of the rods are projected into a cooperating bracket female opening.

The assembly of the closet 10 at a point of use can be readily understood from the description which will now be provided in connection with FIG. 1. The assembly method contemplates unzipping the zipper means 34 to provide the largest extent of the access opening 36 into the compartment 32. The user, whose hand is designated 38, assembles the closet 10 by erecting internally of the cover 12 the cooperating closet-support structure 14 consisting of the interconnected rods 16 and brackets 18. Thus, as should be readily understood from FIG. 1, the user will place within the cover 12 a bracket 16A at the juncture of back panel 26, bottom panel 22, right side panel 30 and, although not shown in FIG. 1, left side panel 28. The erection of the support structure 14 then will be understood to proceed in an orderly fashion. No specific sequence is necessary in accordance with the present invention, but a preferred sequence that could be described as an example of an acceptable sequence, would then have the user 38, again to be noted working internally of the cover 12, create a frictional interconnection of the rods 16A and 16B in the opposite end locations 18B and 18C illustrated in FIG. 1 with the bracket 18A. Next, the rods 16C and 16D are projected into cooperating female holes at opposite ends of the top surface 18D of bracket 18A, as at the locations 18E and 18F. Referring to FIG. 2, and for completeness sake, it is to be noted that the interconnections of the rods and brackets are made at the locations 40A–M being thirteen in number in the exemplary embodiment herein described. At this point it also should be noted that optionally the longer vertically oriented rods can each be one half the size and each half interconnected to each other to provide the single rod length exemplified by rod 16E in FIG. 2.

From the description of the assembly procedure described in connection with FIG. 1, it should be readily apparent and well understood how the completed assembly of rods and brackets, as illustrated in FIG. 3, is readily accomplished, and accordingly for simplicity's sake, and also because it is not deemed to be necessary for a full understanding of the invention, a description of the assembly procedure resulting in the completed assembly of FIG. 3 is omitted as not being necessary.

From what has already been described, it should be readily understood that, after the assembly internally within the cover 12, the closet 10 is in the condition illustrated in FIG. 4 in which it can be conveniently used to support the hooks of hangers having clothes thereon on rod 16F (FIG. 3) serving as a traditional clothes rod.

For completeness' sake it is noted that the panels which comprise the cover 12 are rectangular in shape and will be understood to be attached to each other by stitched seams along confronting edges, as exemplified by seam 12A of FIG. 4. It is also to be noted that underlying the present invention, and thus a significant aspect of that invention is that the three dimensional size of the compartment 32 provided by the panels of cover 12 are approximately the same size as the assembled support structure 14. This has the important consequence of supplementing the friction fit or interconnection between the rods 16 and brackets 18, in that when the zipper means 34 are closed along its vertical track 34B and horizontal track 34A, the fabric construction material of which cover 12 is fabricated is drawn taut or tightly about the support structure 14 and, in this manner, effectively holds the cooperating rods 16 and brackets 18 in their interconnected relationship at the locations 40A–M.

After providing clothes storage service at a point of use, closet 10 is, of course, adapted to be transported for use at another location because it is a readily portable convenience article of manufacture. This, of course, is achieved by removing the clothes contents of closet 10 and, while working through the access opening 36, manually disconnecting the rods 16 and brackets from each other. The disconnected rods 16 and brackets 18 and the now collapsed cover 12 are of a compact size achieving portability for the closet 10.

While the structural components and the method of their use in achieving a portable clothes storage closet herein shown and disclosed in detail is fully capable of attaining the objects and providing the advantages hereinbefore stated, it is to be understood that it is merely illustrative of the presently preferred embodiment of the invention, and that no limitations are intended to the detail of construction or design herein shown other than as defined in the appended claims.

What is claimed is:

1. A method of providing a clothes storage closet using a rectangular closet component of fabric construction material having panels forming a top, a bottom, a front, a back, a left side and a right side which cooperate to bound a storage compartment for said closet, and having zipper means in said front panel for gaining access therethrough into said storage compartment, said method comprising the steps of opening said front panel zipper means incident to obtaining access to the interior of said fabric closet component; erecting within said interior of said fabric closet component a skeletal support of interconnected structural members of a type having cooperating male and female connecting means so as to hold said top panel, said bottom panel, said back panel, said left side panel, and said right side panel in spaced apart relation to each other so as to bound therebetween said storage compartment for said closet, said erected skeletal support being sized to have a snug fit within said storage compartment; closing said front panel zipper means so as to both form a closure for said closet and also to draw taut said fabric of said closet component about said skeletal support so that said male and female interconnecting means are held in place by said fabric tautness during use of said closet; and subsequently opening said front panel zipper means and disassembling within said interior and said fabric closet component said male and female interconnecting means of said skeletal support, whereby said clothes storage closet is placed into a compact storage condition to facilitate storage and transport thereof.

* * * * *